US011517062B2

(12) United States Patent
Timlick

(10) Patent No.: US 11,517,062 B2
(45) Date of Patent: Dec. 6, 2022

(54) HELMET WITH UNIQUE IMPACT ABSORPTION AND REDIRECTION FEATURES

(71) Applicant: Brian Timlick, Winnipeg (CA)

(72) Inventor: Brian Timlick, Winnipeg (CA)

( * ) Notice: Subject to any disclaimer, the term of this patent is extended or adjusted under 35 U.S.C. 154(b) by 771 days.

(21) Appl. No.: 16/408,770

(22) Filed: May 10, 2019

(65) Prior Publication Data

US 2019/0350295 A1 Nov. 21, 2019

Related U.S. Application Data

(60) Provisional application No. 62/671,996, filed on May 15, 2018.

(51) Int. Cl.

| | |
|---|---|
| ***A42B 3/12*** | (2006.01) |
| ***A42B 3/06*** | (2006.01) |
| *A63B 71/10* | (2006.01) |

(52) U.S. Cl.

CPC ..... *A42B 3/064* (2013.01); *A42B 3/121* (2013.01); *A42B 3/125* (2013.01); *A63B 71/10* (2013.01)

(58) Field of Classification Search

CPC ..... A42B 3/064; A42B 3/06; A42B 3/121; A42B 3/28; A42B 3/14

See application file for complete search history.

(56) References Cited

U.S. PATENT DOCUMENTS

| | | | | |
|---|---|---|---|---|
| 3,600,714 | A * | 8/1971 | Cade | A42B 3/121 2/413 |
| 3,818,508 | A * | 6/1974 | Lammers | A42B 3/121 2/412 |
| 3,849,801 | A * | 11/1974 | Holt | A42B 3/121 2/413 |
| 4,375,108 | A * | 3/1983 | Gooding | A42B 3/121 2/909 |
| 9,462,842 | B2 * | 10/2016 | Hoshizaki | A42B 3/064 |
| 2001/0032351 | A1 * | 10/2001 | Nakayama | A42B 3/064 2/412 |
| 2009/0077723 | A1 * | 3/2009 | Mead | A47C 27/20 2/455 |
| 2012/0151664 | A1 * | 6/2012 | Kirshon | A42B 3/12 2/413 |

(Continued)

*Primary Examiner* — Jillian K Pierorazio

(74) *Attorney, Agent, or Firm* — Kyle R Satterthwaite; Ryan W Dupuis; Ade & Company Inc.

(57) ABSTRACT

A helmet features an inner shell, a non-rigid outer shell surrounding the inner shell in outwardly spaced relation therefrom, and a plurality of impact absorbing layers disposed between the shells. Each impact absorbing layer features an envelope, and a plurality of impact absorbing members disposed internally within said envelope. At least one adjacent pair of impact absorbing layers are displaceable relative to one another to enable impact-driven shifting between the adjacent pair, whereby impact energy is absorbed by the impact absorbing members within the impact absorbing layers, and absorbed and/or redirected by the impact-driven shifting between the adjacent absorbing layers. Resiliently stretchable material is attached to the adjacent layers at discrete locations such that, after being stretched by the relative shifting, the material returns to a relaxed state to reset the shifted layers back into a default positional relationship, in which ventilation passages in the absorbing layers are aligned.

17 Claims, 4 Drawing Sheets

(56) References Cited

U.S. PATENT DOCUMENTS

| | | | | |
|---|---|---|---|---|
| 2013/0040524 | A1* | 2/2013 | Halldin | B32B 5/26 442/326 |
| 2013/0247284 | A1* | 9/2013 | Hoshizaki | A42B 3/121 2/413 |
| 2014/0013492 | A1* | 1/2014 | Bottlang | A42B 3/064 2/414 |
| 2015/0157083 | A1* | 6/2015 | Lowe | A42B 3/064 2/412 |
| 2015/0272255 | A1* | 10/2015 | Galaitsis | A42B 3/122 2/413 |
| 2016/0113347 | A1* | 4/2016 | Halldin | A42B 3/145 2/411 |
| 2016/0270471 | A1* | 9/2016 | Merrell | A42B 3/121 |
| 2017/0188648 | A1* | 7/2017 | Larrabee | A42B 3/125 |
| 2018/0057977 | A1* | 3/2018 | Zhang | D03D 15/567 |
| 2018/0303187 | A1* | 10/2018 | Hallander | A42B 3/127 |
| 2018/0317589 | A1* | 11/2018 | Mestas | A42B 3/064 |
| 2019/0335838 | A1* | 11/2019 | Hoshizaki | A42B 3/125 |

* cited by examiner

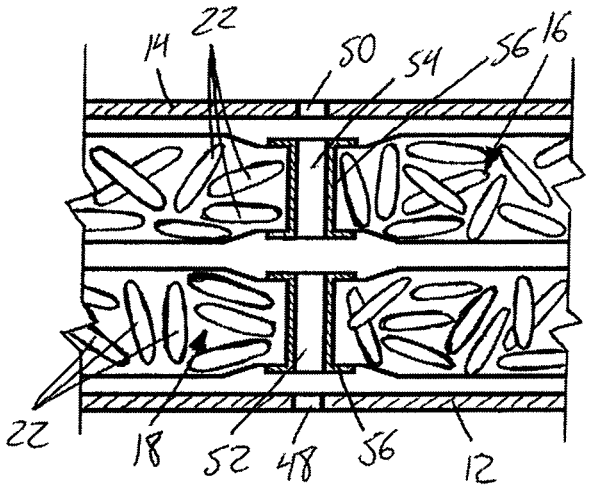
FIG.2A
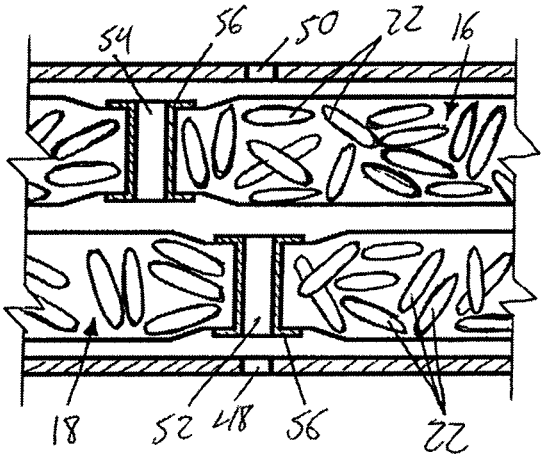
FIG.2B
FIG.3
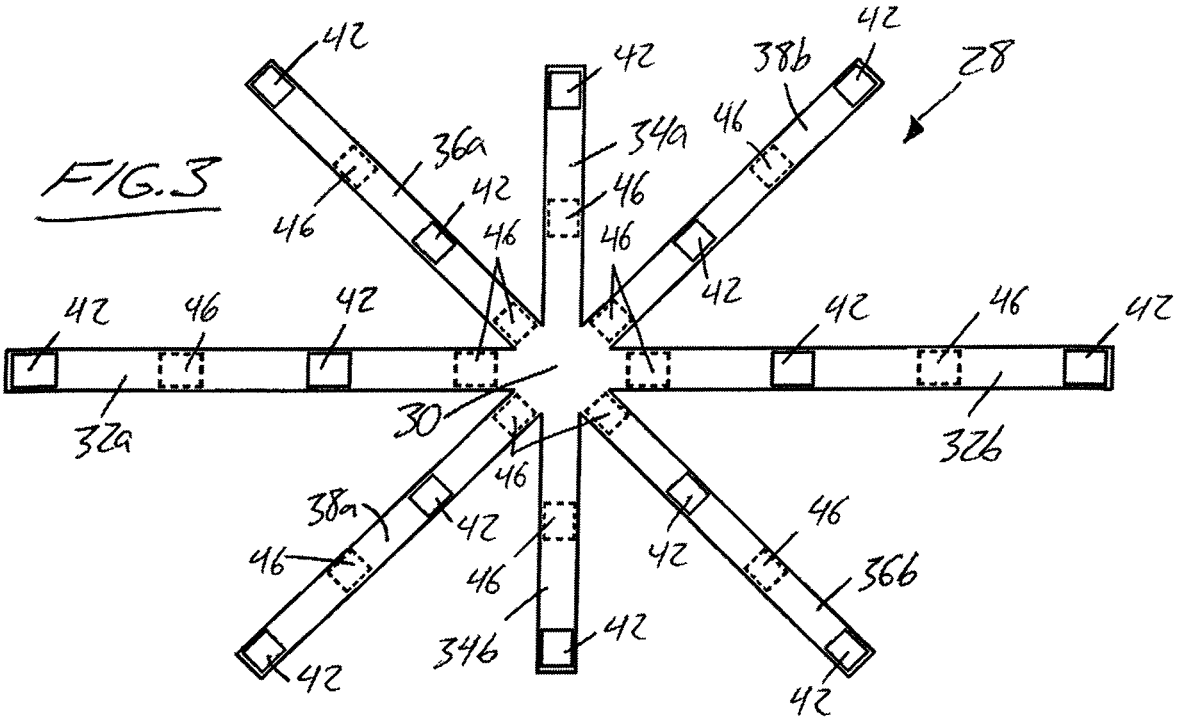

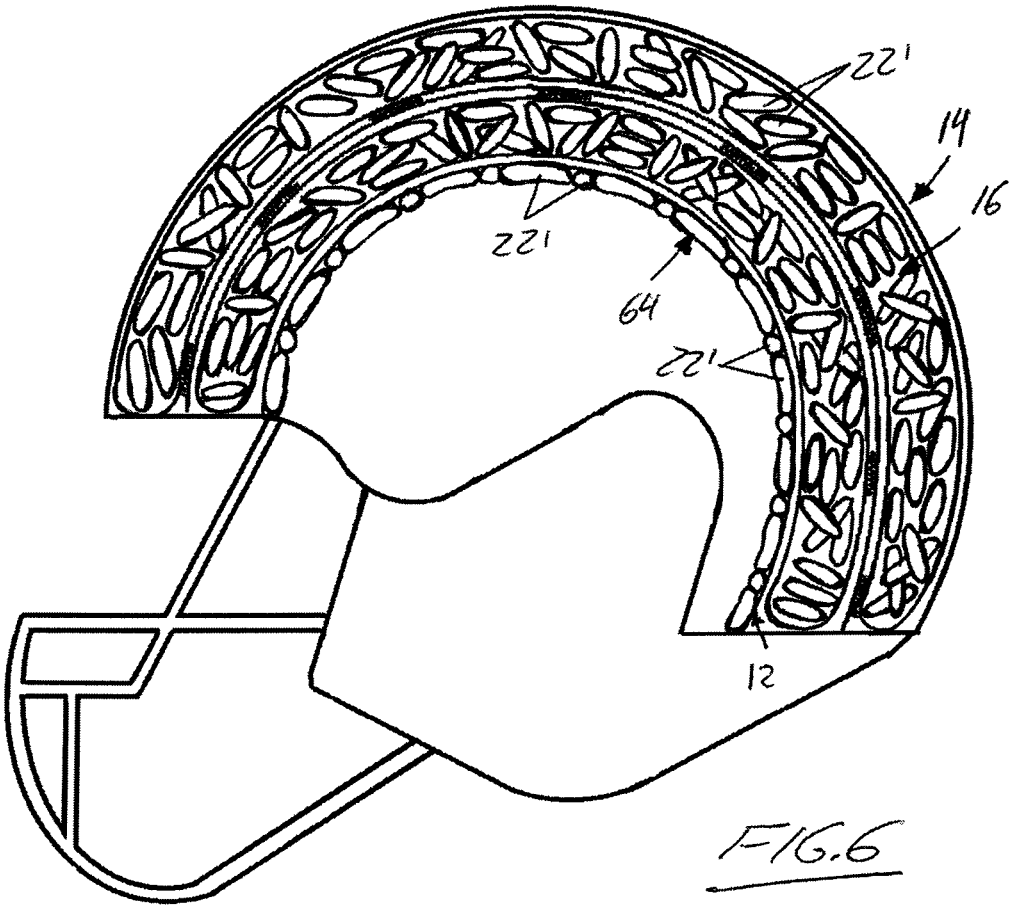
FIG.6
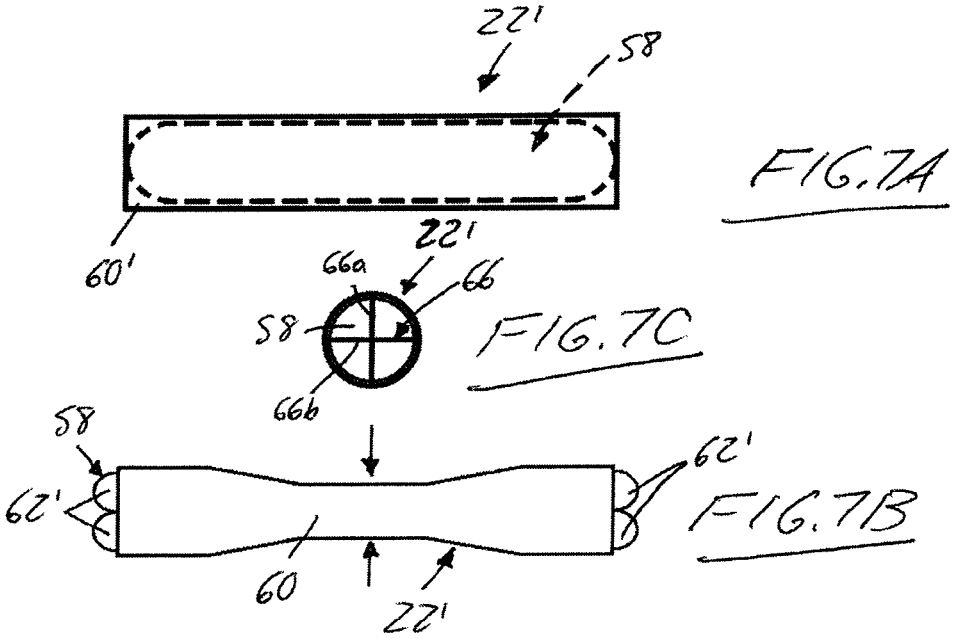
FIG.7A
FIG.7C
FIG.7B

HELMET WITH UNIQUE IMPACT ABSORPTION AND REDIRECTION FEATURES

CROSS-REFERENCE TO RELATED APPLICATIONS

This application claims benefit under 35 U.S.C. 119(e) of U.S. Provisional Application No. 62/671,996, filed May 15, 2018, the entirety of which is incorporated herein by reference.

FIELD OF THE INVENTION

The present invention relates generally to helmets, and more particularly to a helmet with a locally deformable outer shell overlying an inner shell and impact absorbing members sandwiched therebetween.

BACKGROUND

Concussive head injuries in sports have been gaining more attention by the media and general public as of late, in response to which there has been a notable realization of the need for improved athletic head protection.

New helmet designs of interest include those put forth by VICIS Inc. in U.S. Patent Application Publications US20170196291, US20170196295 and US20170303622, each of which is incorporated herein by reference in its entirety. The VICIS designs includes use of impact absorbing members that are situated between inner and outer shells of a helmet and are arranged to undergo buckling under impact of the helmets outer shell.

However, there remains room for unique head protection solutions that build on, or offer an alternative to, such recent developments in the field of athletic head protection.

SUMMARY OF THE INVENTION

According to a first aspect of the invention, there is provided a helmet comprising:

an inner shell for surrounding at least a portion of a wearer's cranium;

an outer shell surrounding the inner shell in outwardly spaced relation therefrom, said outer shell being non-rigid to enable localized deformation thereof under impact;

a plurality of impact absorbing layers disposed between the inner and outer shells, each impact absorbing layer comprising:

an envelope; and a plurality of impact absorbing members disposed internally within said envelope;

wherein said plurality of impact absorbing layers comprise at least one adjacent pair of impact absorbing layers, of which an outermost layer of said adjacent pair of impact absorbing layers is displaceable relative to an innermost layer of said adjacent pair of impact absorbing layers to enable impact-driven shifting between the adjacent pair of impact absorbing layers under impact of the helmet, whereby impact energy is absorbed by the impact absorbing members within the plurality of impact absorbing layers and absorbed and/or redirected by the impact-driven shifting between the adjacent pair of impact absorbing layers.

According to a second aspect of the invention, there is provided a helmet comprising:

an inner shell for surrounding at least a portion of a wearer's cranium;

an outer shell surrounding the inner shell in outwardly spaced relation therefrom, said outer shell being non-rigid to enable localized deformation thereof under impact;

a plurality of impact absorbing layers disposed between the inner and outer shells, said plurality of impact absorbing layers comprise at least one adjacent pair of impact absorbing layers, of which an outermost layer of said adjacent pair of impact absorbing layers is displaceable relative to an innermost layer of said adjacent pair of impact absorbing layers to enable impact-driven shifting between the adjacent pair of impact absorbing layers under impact of the helmet; and stretchable material disposed among the plurality of impact absorbing layers and arranged to stretch during the impact-driven shifting between the adjacent pair of layers.

According to a third aspect of the invention, there is provided a helmet comprising:

an inner shell for surrounding at least a portion of a wearer's cranium;

an outer shell surrounding the inner shell in outwardly spaced relation therefrom, said outer shell being non-rigid to enable localized deformation thereof under impact;

a plurality of impact absorbing layers disposed between the inner and outer shells and including at least one adjacent pair of impact absorbing layers, of which an outermost layer of said adjacent pair of impact absorbing layers is displaceable relative to an innermost layer of said adjacent pair of impact absorbing layers to enable impact-driven shifting between the adjacent pair of impact absorbing layers from an initial positional relationship thereof under impact of the helmet; and a return mechanism operable to return the adjacent pair of impact absorbing layers to the default position relationship after having been shifted therefrom under impact of the helmet.

According to a fourth aspect of the invention, there is provided a helmet comprising:

an inner shell for surrounding at least a portion of a wearer's cranium;

an outer shell surrounding the inner shell in outwardly spaced relation therefrom, said outer shell being non-rigid to enable localized deformation thereof under impact;

at least one impact absorbing layer disposed between the inner and outer shells, said impact absorbing layer comprising a plurality of gas-filled impact absorbing members, each of which comprises:

a balloon having a stretchable skin delimiting a gas-filled interior of said balloon; and an outer sleeve disposed circumferentially around said balloon, said outer sleeve having lesser radial expandability than the stretchable skin of said balloon and having open ends through which said balloon can expand.

BRIEF DESCRIPTION OF THE DRAWINGS

One preferred embodiment of the invention will now be described in conjunction with the accompanying drawings in which:

FIG. 2A is a partial closeup cross-sectional view of the helmet in an initial default state prior to impact, where air vent passages in the impact absorbing layers are aligned with one another.

FIG. 2B is a partial closeup of the same cross-sectional are of FIG. 2A during an impact, where shifting of one impact absorbing layer relative to the other forces the air vent passages out of alignment.

FIG. 3 is an isolated top plan view of a resiliently stretchable interface coupled between the two impact absorbing layers in FIG. 1 to allow relative shifting therebetween during impact of the helmet, before returning the two impact absorbing layers back into their initially aligned positions.

FIG. 6 is a is a cross-sectional view of a variant of the helmet in FIG. 1, featuring a small quantity or larger impact absorbing members in each impact absorbing layer.

FIG. 7A is a closeup detailed side view of one of the impact absorbing members of FIG. 6 in the normal unexpanded state prior to impact.

FIG. 7B is another closeup detailed side view of the impact absorbing member of FIG. 7A, but in the expanded state during impact.

FIG. 7C is a closeup end view of the impact absorbing member of FIG. 7A.

DETAILED DESCRIPTION

Figure 1:
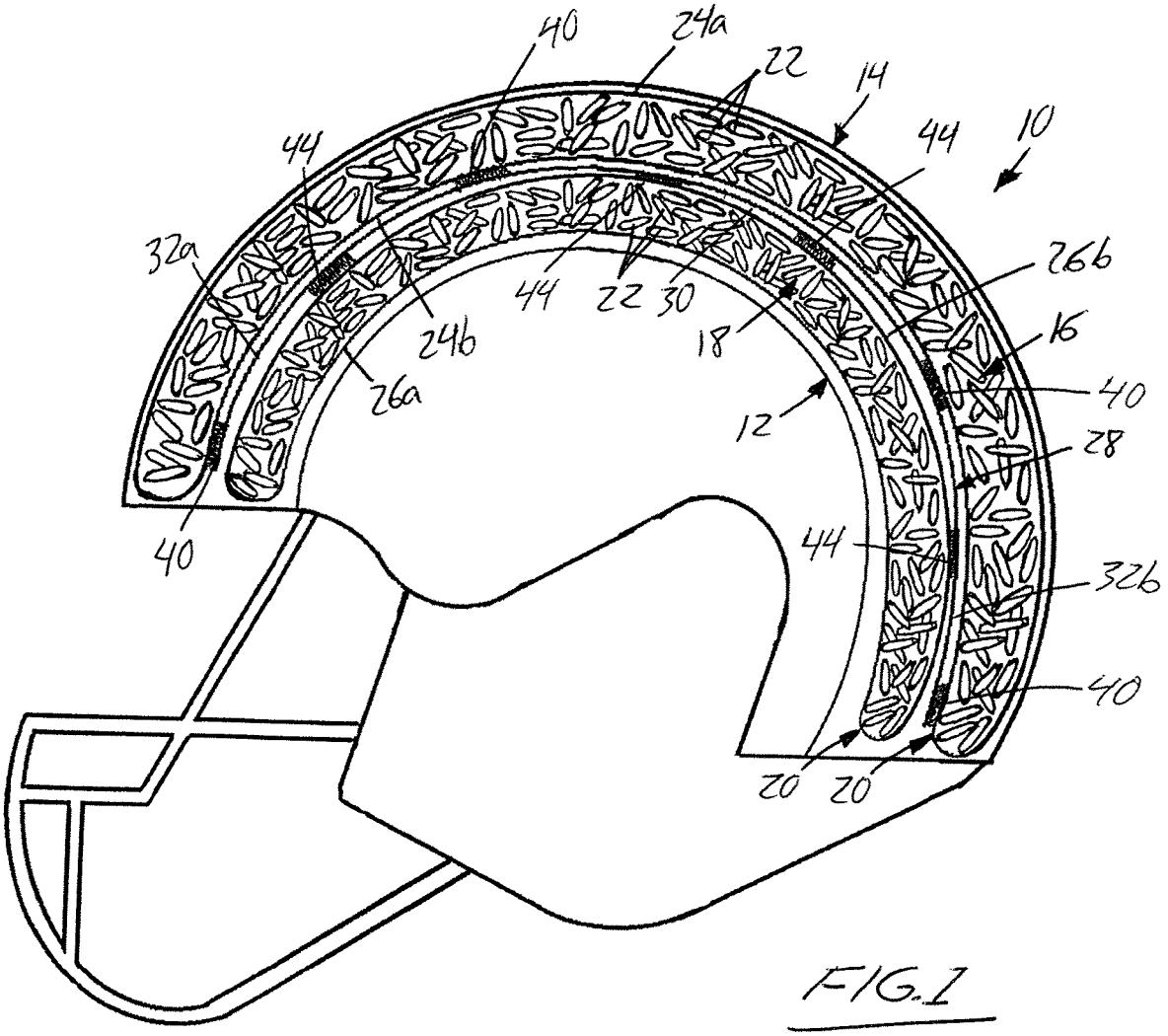
FIG. 1 is a cross-sectional view of a helmet according to the present invention, featuring two different impact absorbing layers that are displaceable relative to one another and each contain a plurality of impact absorbing members, shown without detail.

FIG. 1 shows a schematic cross-section of a helmet 10 according to the present invention. The helmet features a relatively rigid, generally dome-shaped inner shell 12 for surrounding a substantial portion of a wearer's cranium, and a larger generally dome shaped outer shell 14 surrounding the inner shell in outwardly spaced relation therefrom. The outer shell 14 is of a more flexible, less rigid composition than the inner shell 12 to allow localized deformation of the outer shell inwardly toward the inner shell when the outer shell is impacted. A concave inner surface of the inner shell is preferably equipped with suitable padding (omitted in FIG. 1) for fitting the helmet on the wearer's in a close-fitting and comfortable fashion.

A shell space of the helmet delimited between the concave inner surface of the outer shell and the convex outer surface of the inner shell contains a plurality of impact absorbing layers 16, 18, of which there are two in the illustrated embodiment. These two impacting absorbing layers reside respectively adjacent the concave inner surface of the outer shell, and the convex outer surface of the inner shell. The impact absorbing layer residing adjacent the outer shell is thus referred to as the outermost impact absorbing layer 16, or simply the outermost layer, while the impact absorbing layer residing adjacent the inner shell is referred to as the innermost impact absorbing layer 18, or simply the innermost layer.

Figure 4A:
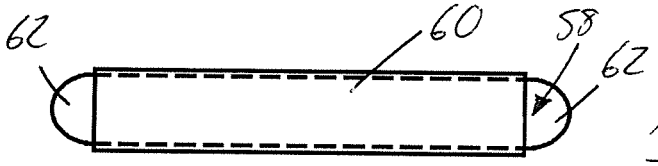
FIG. 4A is a closeup detailed side view of one of the impact absorbing members in a normal unexpanded state prior to impact.
Figure 4B:
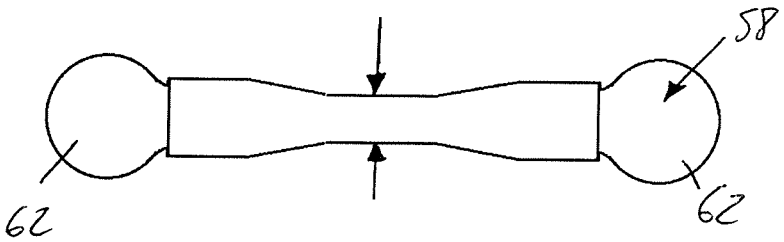
FIG. 4B is another closeup detailed side view of the impact absorbing member of FIG. 4A, but in an expanded state during impact.

Each impact absorbing layer features a fabric enclosure or envelope 20 occupying a respective dome-shaped volume in the shell space of the helmet, and a plurality of impact absorbing members 22 packed inside the fabric envelope 20 in a quantity substantially filling an entirety the fabric envelope 20. FIGS. 1 and 2 show the impact absorbing members iin a simplified form for ease of illustration, while FIGS. 4A and 4B illustrate the particular structure of one embodiment of impact absorbing member 22 in more detail. The impact absorbing members, or simply absorbing members for short, reside in free-floating condition inside the fabric envelope 20, meaning that they are not attached to the fabric walls of the envelope.

A fabric outer wall 24*a* of the outermost layer's envelope resides in a dome-shaped plane immediately or closely adjacent the concave inner side of the outer shell. A fabric inner wall 26*a* of the innermost layer's envelope similarly resides in a dome-shaped plane immediately or closely adjacent the convex outer side of the inner shell. A fabric inner wall 24*b* of the outermost layer's envelope and a fabric outer wall 26*b* of the innermost layer's envelope reside in close but slightly spaced apart dome-shaped planes near a center of the shell space.

Between the fabric inner wall 24*b* of the outermost layer 16 and the fabric outer wall 26*b* of the innermost layer 18, an interface layer features a resiliently stretchable interface 28 by which the innermost and outermost layers are interconnected, yet movable relative to one another. Referring to FIG. 3, the interface 28 features a plurality of elongated strips of resiliently stretchable elastic fabric joined together at a central hub 30 and each extending outward therefrom in a respective radial direction, thus giving the interface a spider-like appearance. The illustrated example features eight strips arranged in parallel opposing pairs, whereby one longitudinally oriented pair 32*a*, 32*b* lies longitudinally front to back of the helmet, a laterally oriented pair 34*a*, 34*b* lies side to side of the helmet, and two obliquely oriented pairs 36*a*, 36*b*, 38*a*, 38*b* lie diagonally of the helmet. However, the quantity and directionality of the elongated strips of resiliently stretchable fabric may vary. The helmet of FIG. 1 is cross-sectioned in a longitudinal mid-plane of the helmet, which cuts through the longitudinal pair of fabric strips 32*a*, 32*b* and the hub 30 situated therebetween Referring again to FIG. 1, a first set of hook and loop fasteners 40 couple an outwardly facing topside of the interface 28 to the inner fabric wall of the outermost impact absorbing layer at discretely spaced locations thereon. Each hook and loop fastener 40 in the first set features a plurality a fabric hook or loop patches 42 affixed to the topside of the interface at spaced positions along the elongated fabric strips thereof, and a plurality of mating fabric loop or hook patches affixed to the inner fabric wall 24*b* of the outermost impact absorbing layer at matching positions thereon. A second set of hook and loop fasteners 44 couple an inwardly facing underside of the interface 28 to the outer fabric wall 26*b* of the innermost impact absorbing layer at discretely spaced locations thereon. Each hook and loop fastener 44 in the second set features a plurality a fabric hook or loop patches 46 affixed to the underside of the interface 28 at spaced positions along the elongated fabric strips thereof, and a plurality of mating fabric loop or hook patches affixed to the outer fabric wall 26*b* of the innermost impact absorbing layer at matching positions thereon.

The hook or loop patches 42 on the topside of the interface 28 and the hook or loop patches 46 on the underside of the interface 28 alternate with one another at spaced intervals along the length of each elongated fabric strip of the interface. Accordingly, each assembled hook and loop fastener of the first set is spaced from a nearest hook and loop fastener of the second set in the length direction of the respective strip of the interface. The stretchability of the interface fabric allows the distance between any neighbouring pair of fasteners from the first and second set to be selectively expanded by pulling of the respective elongated strip outwardly from the hub. Once the pulling force is removed, the resilient fabric of the strip returns to its initial unstretched state, thus resetting the distance between the neighbouring fasteners back to a normal default value. Through the two sets of fasteners, the interface 28 connects the innermost and outermost layers together, while allowing relative movement to take place therebetween due to the elastic stretchability of the interface fabric in the elongated direction of each strip.

Referring to FIG. 2, the inner and outer shells feature respective vent openings, of which those in the inner shell are referred to as inner vent openings 48, while those in the outer shell are referred to as outer vent openings 50. Each inner vent opening 48 is aligned with a respective outer vent opening 50 across the shell space of the helmet, and also opens through any padding found on the inner side of the inner shell. To enable airflow through each aligned pair of inner and outer vent openings, the innermost and outermost impact absorbing layers feature respective vent passages 52, 54 that perforate through the inner and outer fabric walls of their envelopes at discretely spaced locations spread out over the surface areas thereof. The vent passages in the innermost and outermost layers are respectively referred to herein as inner and outer vent passages 52, 54. As shown in FIG. 2A, each vent passage may be defined by a grommet 56 that penetrates the envelope of the respective impact absorbing layer. As illustrated, the grommet may pinch the envelope down to a reduced thickness relative to neighbouring areas of the envelope, where the impact absorbing members 22 packed inside the envelope maintain a greater envelope thickness than at the pinched-together grommeted area. This way, the grommets don't create an obstruction to smooth sliding movement between the envelopes of the impact absorbing layers during relative movement therebetween. As shown in FIG. 2A, the vent passages 52, 54 normally align with one another and with the inner and outer vent openings 48, 50 in the inner and outer shells to enable air flow through the helmet for improved ventilation and cooling of the wearer's head. However, as shown in FIG. 2B, the vent passages may be forced out of alignment by relative displacement between the impact absorbing layers when the helmet undergoes impact.

FIGS. 4A and 4B illustrate one example of a type of impact absorbing member 22 that may be used within the envelopes of the impact absorbing layers. The absorbing member 22 features a gas-filled, e.g. air-filled, balloon 58 of elongated shape, and an outer compression sleeve 60 fitted circumferentially around the balloon at an intermediate area thereof situated centrally between longitudinally opposing ends of the balloon. The balloon 58 has a resiliently stretchable skin, for example made of latex, which delimits the gas-filled interior space of the balloon. Through this stretchable nature of the skin, compression of a localized area of the balloon causes expansion of other areas thereof. The outer compression sleeve 60 is made of a material of lesser expandability than the skin of the balloon, at least in the radial direction of the sleeve, whereby radial expansion of the balloon's sleeved intermediate area is restricted by the less stretchable compression sleeve. Accordingly, as schematically illustrated in FIG. 4B, radial compression forces exerted on the sleeved intermediate area of the balloon causes expansion of exposed end areas 62 of the balloon situated outwardly beyond the open ends of the sleeve.

When the non-rigid outer shell of the helmet is subjected to an impact and thus deflects inwardly toward the inner shell, a component of the impact force acting generally radially of the helmet attempt to compress the impact absorbing layers, during which the impact absorbing members at the areas thereof underlying the point of impact are squeezed, during which energy from this radial component of the impact force is at least partially absorbed by stretched expansion of unsleeved areas of the air-filled absorbing members. At the same time, a component of the impact force acting generally tangentially of the helmet drives tangential sliding or slippage of the outermost layer along the outer fabric wall of the innermost layer, during which energy from this tangential component of the impact force is at least partially absorbed or redirected through the relative movement of the outermost layer and the stretching of the resilient material in the interface layer during this movement. Such absorption/redirection of tangential forces reduces the effective torque that would otherwise be transferred to the wearer's head.

Figure 5:
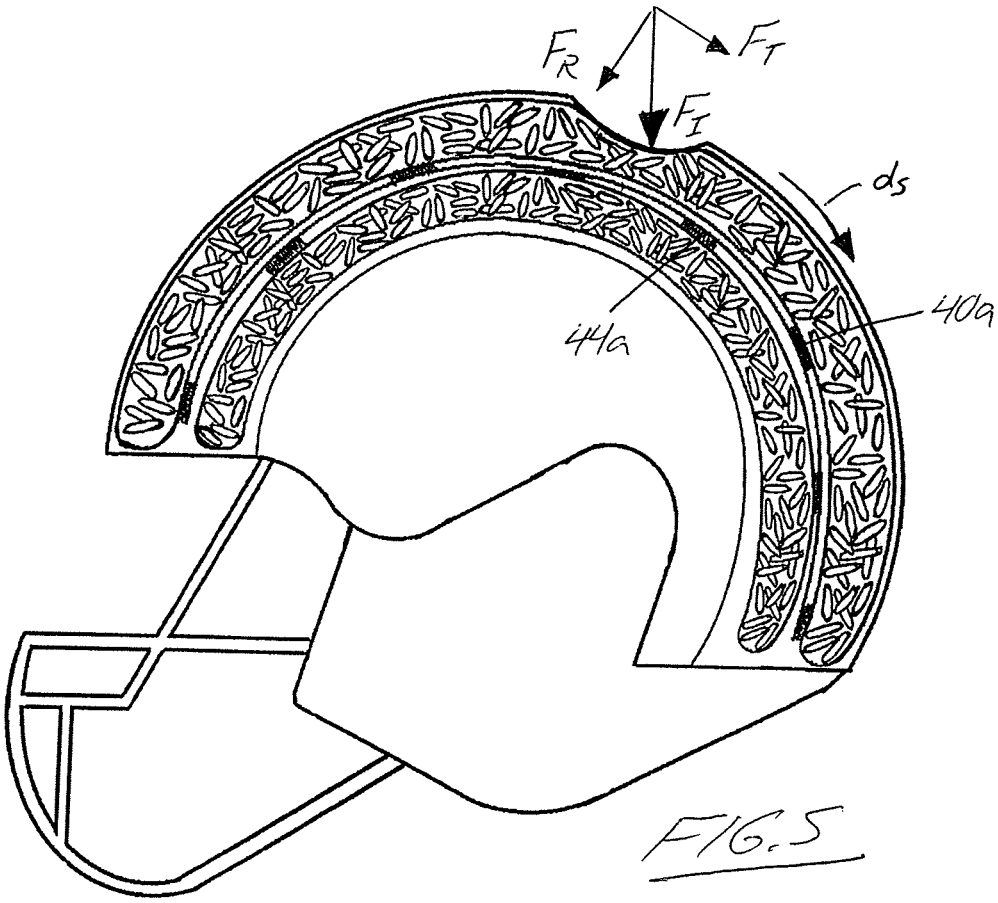
FIG. 5 is a cross-sectional view of the helmet of FIG. 1 during impact.

This is illustrated schematically in FIG. 5. Here, impact force vector $F_I$ is illustrated as impacting the outer shell and being broken down into two orthogonal component vectors, namely radial force vector $F_R$ and tangential force vector $F_T$. The radial force vector $F_R$ exerts localized compression of the impact absorbing layers 16, 18 toward the inner shell, during which the impact absorbing members 22 contained at these compressed areas of both layers are squeezed, during which the outward bulging of the unsleeved areas 62 of the absorbing member balloons 58 absorbs impact energy to reduce that which is transferred to the wearer's head through the inner shell. In the illustrated example, where the impact force vector acts generally downwardly at the crown of the head, the tangential force vector $F_T$ causes the outermost impact absorbing layer 16 to shift rearwardly and downwardly over the innermost impact absorbing layer 18, as shown by shift arrow S. The hook and loop fastener 40*a* that couples the outermost impact absorbing layer to the interface 28 on rearward longitudinal strip 32*b* thereof is pushed downward by this shifting movement of the outermost layer, thus stretching the portion of the longitudinal strip 32*b* situated between this fastener 40*a* of the first set and the fastener 44*a* of the second set that is situated between fastener 40*a* and the point of impact. This stretching allows the shifting of the outermost layer to occur relative to the innermost layer, after which the resilient relaxation of the interface 28 back into its unstretched state will pull fastener 40*a* back to its original location. This way, after impact of the helmet, the misaligned vent passages moved will be returned back into proper alignment to enable continued use of the helmet without detriment to the ventilated comfort thereof.

The helmet of the present invention is unique in its use of both impact absorption by a collection of absorbing members contained in two separate layers, and by relative movement between those layers. The helmet is also unique in the use of a resiliently stretchable interface in a multi-layer helmet to create an effective return mechanism that returns the the shifted impact absorbing layer back into its original unshifted position relative to the adjacent layer. Such a return action may be beneficial regardless of whether the helmet includes vent openings and passages that are automatically realigned by the resilient relaxation of the momentarily stretched interface of the return mechanism.

FIG. 6 shows a variant of helmet in which the absorbing members 22' are of larger relative size to the fabric envelopes in which they are contained, thus requiring a lesser quantity of absorbing members to fill each envelope. Accordingly, the relative sizing of the absorbing members may be varied relative to other components of the helmet. FIG. 6 also illustrates inclusion of an additional padding layer 64 on the inner surface of the inner shell 12 of the helmet, and the optional formation of this padding layer of additional absorbing members 22' of the same type employed in the impact absorbing layers. The compression sleeves of these additional absorbing members 22' of the padding layer 64 are adhered or otherwise affixed to the inner surface of the inner shell 12, while the balloons of these additional absorbing members 22' are free to expand and relax relative to the shell affixed compression sleeves.

FIGS. 7A through 7C illustrate the absorbing members of FIG. 6, which in addition to being of larger scale, differ from those of FIGS. 4A and 4B in that in the normal unexpanded or relaxed state of the balloon 58', the ends thereof don't protrude outwardly from the ends of the compression sleeve 60'. That is, in this variant, the axial length of the relaxed balloon is shorter than that of the compression sleeve. Additionally, each end of the compression sleeve 60' is equipped with a stopper 66 for the purpose of preventing the balloon 58' from sliding fully out of the compression sleeve 60' in either direction. Each stopper may comprise a fabric net or web comprising at least two crossing strands 66*a*, 66*b* spanning across the otherwise open end of the compression sleeve 60' to prevent axial escape of the balloon, while allowing end areas 62' of the balloon to bulge outwardly through openings in the net or web, as shown in FIG. 7B. In the illustrated example, the net or web stopper 66 features two perpendicularly crossing strands 66*a*, 66*b* each spanning diametrically across the otherwise open end of the compression sleeve, thus delimiting four open quadrants through which the balloon can bulge outwardly from the compression sleeve in the expanded state of the balloon.

While the illustrated embodiment includes only two impact absorbing layers, thus forming a sole pair of adjacent impact absorbing layers interconnected by a single interface layer, other embodiments may include one or more additional impact absorbing layers. For example, in an embodiment with a third impact absorbing layer, there would be two adjacent pairs of impact absorbing layers, among which the two adjacent impact absorbing layers of each pair would be interconnected by a respective one of two interface layers.

While the illustrated embodiment shows a football helmet with a face cage attached to the more rigid inner shell, it will be appreciated that the above described structure and operating principles may likewise be applied to other helmets for any variety of sports and activities. Also, while the illustrated embodiment employs unique air-filled impact absorbing members with an expandable but sleeve-constrained balloon, other known types of impact absorbing members may be employed within the unique multi-layer relatively displaceable design of the present invention, whether such absorbing members use compression and expansion of gas-filled or other fluid-filled (e.g. liquid-filled, or gel-filled) members, or deformation or buckling of solid or hollow structures. Examples of other impact absorbing members that may be used include any of the impact absorbing structures illustrated and described in the aforementioned VICIS applications, which are incorporated herein by reference.

Also, while the illustrated embodiment employs fabric to enclose the impact absorbing members, for example fabric envelopes originally made with an openable flap by which they are fillable with the impact absorbing members before permanent or re-openable closure of the flap once ready for assembly with the shells, other embodiments may employ envelopes/enclosures of more rigid non-fabric wall structure, provided that the outer wall of the innermost layer and inner wall of the outermost layer are of co-operable convex and concave shapes to enable relative sliding therebetween.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A helmet comprising:

an inner shell for surrounding at least a portion of a wearer's cranium;

an outer shell surrounding the inner shell in outwardly spaced relation therefrom, said outer shell being non-rigid to enable localized deformation thereof under impact;

a plurality of impact absorbing layers disposed between the inner and outer shells, each impact absorbing layer comprising:

an envelope; and a plurality of balloons disposed internally within said envelope in a free- floating condition thereinside;

said plurality of impact absorbing layers comprising at least one adjacent pair of impact absorbing layers, of which an outermost layer of said adjacent pair of impact absorbing layers is displaceable relative to an innermost layer of said adjacent pair of impact absorbing layers to enable impact-driven shifting between the adjacent pair of impact absorbing layers under impact of the helmet, whereby impact energy is absorbed by the balloons within the plurality of impact absorbing layers and absorbed and/or redirected by the impact-driven shifting between the adjacent pair of impact absorbing layers; and an interface layer that is disposed between said adjacent pair of impact absorbing layers and is composed of a spider-like arrangement of elongated strips of resiliently stretchable character that are joined together at, and radiate outward, from a central hub, said interface layer having a topside that is fastened to the envelope of the outermost layer of said adjacent pair of impact absorbing layers at a first set of discretely spaced fastening locations, and an underside that is fastened to the envelope of the innermost layer of said adjacent pair of impact absorbing layers at a second set of discretely spaced fastening locations, and on each elongated strip, there is a first fastening location belonging to the first set of fastening locations and a second fastening location belonging to the second set of fastening locations, and said first and second fastening locations are spaced from one another along a length of the elongated strip, whereby the resiliently stretchable character of the elongated strip allows a distance between said first and second fastening locations to be expanded during said impact-driven shifting between the adjacent pair of impact absorbing layers, and then reset by relaxation of the elongated strip to an unstretched state after said impact.

2. The helmet of claim 1 wherein the adjacent pair of impact absorbing layers have an initial positional relationship prior to impact of the helmet, and the interface layer is operable to return the adjacent pair of impact absorbing layers to the initial positional relationship after having been shifted therefrom under impact of the helmet.

3. The helmet of claim 2 comprising outer vent openings in the outer shell, inner vent openings in the inner shell, and vent passages in the adjacent pair of impact absorbing layers, wherein the vent passages in the adjacent pair of impact absorbing layers align with one another and with the inner and outer vent openings in the initial positional relationship between the adjacent pair of impact absorbing layers, whereby the interface layer is operable to re-align the vent passages with one another after said impact.

4. The helmet of claim 1 comprising outer vent openings in the outer shell, inner vent openings in the inner shell, and vent passages in the adjacent pair of impact absorbing layers, wherein the vent passages align with one another and with the inner and outer vent openings in an initial positional relationship between the adjacent pair of impact absorbing layers prior to said impact-driven shifting, during which said vent passages become misaligned, and after which said relaxation of the interface layer pulls the adjacent pair of impact absorbing layers back into the initial positional relationship to re-align said vent passages after said impact.

5. The helmet of claim 1 wherein the interface layer is fastened to of the adjacent pair of impact absorbing layers by hook and loop fasteners at said first and second sets of fastening locations.

6. The helmet of claim 1 wherein each balloon is a fluid-filled balloon.

7. The helmet of claim 1 wherein each balloon has an outer sleeve disposed circumferentially therearound, said outer sleeve having lesser radial expandability than said balloon, and also having at least partially open ends through which said balloon can expand.

8. The helmet of claim 7 wherein said at least partially open ends are partially open ends equipped with stoppers for preventing axial escape of the balloon from the outer sleeve.

9. The helmet of claim 1 wherein the envelope of each impact absorbing layer comprises fabric walls.

10. A helmet comprising:

an inner shell for surrounding at least a portion of a wearer's cranium;

an outer shell surrounding the inner shell in outwardly spaced relation therefrom, said outer shell being non-rigid to enable localized deformation thereof under impact;

a plurality of impact absorbing layers disposed between the inner and outer shells, said plurality of impact absorbing layers comprise at least one adjacent pair of impact absorbing layers, of which an outermost layer of said adjacent pair of impact absorbing layers is displaceable relative to an innermost layer of said adjacent pair of impact absorbing layers to enable impact-driven shifting between the adjacent pair of impact absorbing layers under impact of the helmet; and an interface layer that is disposed between said adjacent pair of impact absorbing layers and is composed of a spider-like arrangement of elongated strips of resiliently stretchable character that are joined together at, and radiate outward, from a central hub, said interface layer having a topside that is fastened the outermost layer of said adjacent pair of impact absorbing layers at a first set of discretely located fastening locations, and an underside that is fastened to the innermost layer of said adjacent pair of impact absorbing layers at a second set of discretely spaced fastening locations, and on each elongated strip, there is a first fastening location belonging to the first set of fastening locations and a second fastening location belonging to the second set of fastening locations, and said first and second fastening locations are spaced from one another along a length of the elongated strip, whereby the resiliently stretchable character of the elongated strip allows a distance between said first and second fastening locations to be expanded during the impact-driven shifting between the adjacent pair of impact absorbing layers, and then reset by relaxation of the strip to an unstretched state after said impact.

11. A helmet comprising:

an inner shell for surrounding at least a portion of a wearer's cranium;

an outer shell surrounding the inner shell in outwardly spaced relation therefrom, said outer shell being non-rigid to enable localized deformation thereof under impact;

a plurality of impact absorbing layers disposed between the inner and outer shells and including at least one adjacent pair of impact absorbing layers, of which an outermost layer of said adjacent pair of impact absorbing layers is displaceable relative to an innermost layer of said adjacent pair of impact absorbing layers to enable impact-driven shifting between the adjacent pair of impact absorbing layers from an initial positional relationship thereof under impact of the helmet;

a return mechanism operable to return the adjacent pair of impact absorbing layers to the default position relationship after having been shifted therefrom under impact of the helmet; and outer vent openings in the outer shell, inner vent openings in the inner shell, and vent passages in the adjacent pair of impact absorbing layers, wherein the vent passages in the adjacent pair of impact absorbing layers align with one another and with the inner and outer vent openings in the initial positional relationship between the adjacent pair of impact absorbing layers, whereby the return mechanism is operable to re-align the vent passages with one another after said impact.

12. A helmet comprising:

an inner shell for surrounding at least a portion of a wearer's cranium;

an outer shell surrounding the inner shell in outwardly spaced relation therefrom, said outer shell being non-rigid to enable localized deformation thereof under impact;

at least one impact absorbing layer disposed between the inner and outer shells, said impact absorbing layer comprising:

an envelope; and a plurality of balloons disposed internally within said envelope in a free-floating condition thereinside, wherein said balloons are of unattached relationship to one another, and each respectively encapsulate a discrete volume of fluid therein.

13. The helmet of claim 12 wherein each balloon has an outer sleeve disposed circumferentially therearound, said outer sleeve having lesser radial expandability than said balloon, and also having at least partially open ends through which said balloon can expand.

14. The helmet of claim 13 wherein said at least partially open ends are partially open ends equipped with stoppers for preventing axial escape of the balloon from the outer sleeve.

15. The helmet of claim 14 wherein each balloon is a gas-filled balloon.

16. The helmet of claim 12 wherein each balloon is a gas-filled balloon.

17. The helmet of claim 13 wherein each balloon is a gas-filled balloon.

* * * * *